US012253079B2

(12) United States Patent
Oga et al.

(10) Patent No.: US 12,253,079 B2
(45) Date of Patent: Mar. 18, 2025

(54) OILING DEVICE AND ABNORMALITY DETECTION METHOD OF THE SAME

(71) Applicant: KOBELCO COMPRESSORS CORPORATION, Tokyo (JP)

(72) Inventors: Jumpei Oga, Hyogo (JP); Toshiyuki Miyatake, Hyogo (JP); Iori Yoneda, Hyogo (JP)

(73) Assignee: KOBELCO COMPRESSORS CORPORATION, Tokyo (JP)

( * ) Notice: Subject to any disclaimer, the term of this patent is extended or adjusted under 35 U.S.C. 154(b) by 0 days.

(21) Appl. No.: 18/004,288

(22) PCT Filed: Jul. 13, 2021

(86) PCT No.: PCT/JP2021/026328
§ 371 (c)(1),
(2) Date: Jan. 4, 2023

(87) PCT Pub. No.: WO2022/014600
PCT Pub. Date: Jan. 20, 2022

(65) Prior Publication Data

US 2023/0243352 A1 Aug. 3, 2023

(30) Foreign Application Priority Data

Jul. 16, 2020 (JP) ..... 2020-122228

(51) Int. Cl.
*F04C 15/00* (2006.01)
*F01M 1/02* (2006.01)
(Continued)

(52) U.S. Cl.
CPC ..... *F04C 15/0092* (2013.01); *F01M 1/02* (2013.01); *F01M 1/16* (2013.01); *F01M 1/22* (2013.01);
(Continued)

(58) Field of Classification Search
CPC ..... F04C 15/0092; F04C 2/16; F04C 13/002; F04C 28/24; F04C 18/16; F04C 28/08;
(Continued)

(56) References Cited

U.S. PATENT DOCUMENTS 3,873,239 A * 3/1975 Jamieson ..... F04C 28/24 417/295
6,107,693 A * 8/2000 Mongia ..... F02C 3/28 290/40 C
(Continued)

FOREIGN PATENT DOCUMENTS

JP S60-120157 A 6/1985
JP 2000-205140 A 7/2000
(Continued)

OTHER PUBLICATIONS

International Search Report issued in PCT/JP2021/026328; mailed Aug. 31, 2021.
(Continued)

*Primary Examiner* — Syed O Hasan
(74) *Attorney, Agent, or Firm* — Studebaker Brackett PLLC

(57) ABSTRACT

An oiling device includes a passage system that circulates and feeds oil to an oiling object. A control unit includes a storage unit that has stored therein a first abnormality pressure set value that differs according to oiling temperature; the first abnormality pressure set value is set to a lower pressure as the oiling temperature is higher. The control unit executes an abnormal stop of the oiling object when an oiling pressure detected by an oiling pressure detecting unit is equal to or lower than the first abnormality pressure set value corresponding to an oiling temperature detected by an oiling temperature detecting unit.

13 Claims, 16 Drawing Sheets

(51) Int. Cl.

| | |
|---|---|
| ***F01M 1/16*** | (2006.01) |
| ***F01M 1/22*** | (2006.01) |
| ***F01M 5/00*** | (2006.01) |
| ***F04C 2/16*** | (2006.01) |
| ***F04C 13/00*** | (2006.01) |

(52) U.S. Cl.
CPC ..... *F01M 5/002* (2013.01); *F04C 2/16* (2013.01); *F04C 13/002* (2013.01); *F01M 2250/60* (2013.01)

(58) Field of Classification Search
CPC ..... F04C 29/021; F01M 1/02; F01M 1/16; F01M 1/22; F01M 5/002; F01M 2250/60
See application file for complete search history.

(56) References Cited

U.S. PATENT DOCUMENTS

| | | | | |
|---|---|---|---|---|
| 7,403,850 | B1 * | 7/2008 | Boutin | G01M 15/05 701/107 |
| 2007/0140866 | A1 * | 6/2007 | Tanaka | F04C 29/126 417/310 |
| 2018/0094536 | A1 * | 4/2018 | Crothers | G01M 15/14 |
| 2018/0229847 | A1 * | 8/2018 | Smallhorn | B64D 11/0624 |
| 2019/0338792 | A1 | 11/2019 | Hayashi et al. | |
| 2020/0132570 | A1 * | 4/2020 | Lucke | F02D 41/22 |

FOREIGN PATENT DOCUMENTS

| | | | |
|---|---|---|---|
| JP | 2007-205358 | A | 8/2007 |
| JP | 2008-128085 | A | 6/2008 |
| JP | 2011-007194 | A | 1/2011 |
| JP | 2018-028290 | A | 2/2018 |
| JP | 2018-076847 | A | 5/2018 |
| JP | 2019-002292 | A | 1/2019 |
| JP | 2019-085970 | A | 6/2019 |
| JP | 2019-194448 | A | 11/2019 |

OTHER PUBLICATIONS

International Preliminary Report on Patentability and Written Opinion issued in PCT/JP2021/026328; issued Jan. 17, 2023.

* cited by examiner

OILING DEVICE AND ABNORMALITY DETECTION METHOD OF THE SAME

CROSS-REFERENCE TO RELATED APPLICATIONS

This is a national phase application in the United States of International Patent Application No. PCT/JP2021/026328 with an international filing date of Jul. 13, 2021, which claims priority of Japanese Patent Application No. 2020-122228 filed on Jul. 16, 2020 the contents of which are incorporated herein by reference.

TECHNICAL FIELD

The present invention relates to an oiling device and its abnormality detection method.

BACKGROUND ART

In a package-type compressor, besides a compressor body, various devices including accessories, such as an oiling device, and parts are housed in a limited space JP 2018-28290 A). Thus, in general, by setting environmental conditions, such as ambient temperature, discharge pressure of the compressor body, and so on as specifications, each device is designed to be a necessary and sufficient one, i.e., to not be over-engineered and not grow in size. Further, the package-type compressor is provided with a function of an alarm or an emergency stop based on an interlock value to avoid the device operating in an out-of-specification, irregular state and thereby protect the device.

Also as for the oiling device, there are known those having the function of an alarm or an emergency stop. For example, in an oiling device for a compressor disclosed in JP S60-120157 A, an abnormality of oiling from an oil pump to an oiling part is determined based on a predetermined interlock value relating to oiling pressure. In other words, there is generally known a method of indirectly determining insufficiency of the amount of oiling from oiling pressure and causing the compressor to stop if the oiling pressure falls below the interlock value.

SUMMARY OT INVENTION

The oiling pressure is affected by the viscosity of oil. Specifically, even when the amount of oiling is the same, the oiling pressure increases if oil is highly viscous. The viscosity of oil is affected by oil temperature. Specifically, oil has a tendency to be relatively high in viscosity if the oil temperature is low and be relatively low in viscosity if the oil temperature is high. That is, in a case where the amount of oiling is constant, the oiling pressure at the time when the oil temperature is low temperature is higher than the oiling pressure at the time when the oil temperature is high temperature. Therefore, to ensure the amount of oiling at all oil temperatures in conceivable operating conditions based on an interlock value that does not take the oil temperature into consideration as in Patent Document 2, it is necessary to set the interlock value depending on a case of the minimum oil temperature, i.e., a case where the amount of oiling is lowest with respect to the oiling pressure.

However, in a case where the oil temperature is high, because of a decrease in the viscosity of oil, the oiling pressure required to ensure the same amount of oiling is lowered as compared with in a case where the oil temperature is low. In a case where an interlock value of the oiling pressure has been set as described above, at the time of high oil temperature, the oiling pressure falls below the interlock value even though the necessary amount of oiling has been ensured, and thus the flow rate of the oil pump has to be increased more than necessary to satisfy the interlock value; for example, the size of the oil pump needs to be increased. As seen from the above, in the conventional technique that does not take the oil temperature into consideration, it requires overfeeding of oil, and therefore it is not possible to avoid wasteful energy consumption. That is, the conventional technique has room for improvement on contribution to energy saving.

An object of the present invention is to provide an oiling device and its abnormality detection method that can contribute to energy saving.

Means for Solving the Problems

A first aspect of the present invention is to provide an oiling device including: a passage system that circulates and feeds oil to an oiling object; an oiling pressure detecting unit that detects an oiling pressure that is a pressure of the oil fed to the oiling object through the passage system; an oiling temperature detecting unit that detects an oiling temperature that is a temperature of the oil fed to the oiling object through the passage system; and a control unit that executes an abnormal stop of the oiling object, in which the control unit includes a storage unit that has stored therein a first abnormality pressure set value that differs according to the oiling temperature, the first abnormality pressure set value is set to a lower pressure as the oiling temperature is higher, and the control unit executes an abnormal stop of the oiling object when the oiling pressure detected by the oiling pressure detecting unit is equal to or lower than the first abnormality pressure set value corresponding to the oiling temperature detected by the oiling temperature detecting unit.

In a case where the oil temperature is high, because of a decrease in the viscosity of oil, the oiling pressure required to ensure the same amount of oiling is lowered as compared with in a case where the oil temperature is low. The higher the oiling temperature is, the lower the first abnormality pressure set value stored in the storage unit of the control unit is set to; therefore, it does not happen that when the oiling temperature is high, the oiling pressure of the oiling device becomes high, and oil is overfed even though the necessary amount of oiling has been ensured to avoid an abnormal stop of the oiling object. In this way, it is possible to avoid overfeeding of oil at the time of high oil temperature, and therefore it is possible to reduce power required of the oiling device and contribute to energy saving.

It may be configured that the oiling device further includes an alarm unit that sends out an abnormality alarm, in which the storage unit has further stored therein a second abnormality pressure set value that differs according to the oiling temperature, the second abnormality pressure set value is set to a lower pressure as the oiling temperature is higher, and is set to a higher pressure than the first abnormality pressure set value in a case of the same oiling temperature, and the control unit causes the alarm unit to send out the abnormality alarm when the oiling pressure detected by the oiling pressure detecting unit is equal to or lower than the second abnormality pressure set value corresponding to the oiling temperature detected by the oiling temperature detecting unit.

It may be configured that the oiling device includes a first motor that drives the oiling object, in which the oiling object is a screw compressor including male and female rotors driven by the first motor.

By the reduction of the power required of the oiling device because of the fact that there is no need to wastefully increase the oiling pressure of the oiling device to avoid an abnormal stop at the time of high oiling temperature, it is possible to contribute to energy saving.

The oiling device may include an oil pump that is driven by the first motor thereby generating the oiling pressure.

It may be configured that: the screw compressor includes a first inverter for controlling the rotational frequency of the first motor; the storage unit stores therein a relationship between the rotational frequency of the first motor and the first abnormality pressure set value as a plurality of functions defined according to the oiling temperature; and the plurality of functions are set such that the first abnormality pressure set value with respect to the same rotational frequency of the first motor to becomes lower as the oiling temperature is higher.

In this configuration there is no need to wastefully increase the oiling pressure of the oiling device at each of different rotational frequencies of the first motor to avoid an abnormal stop at the time of high oiling temperature, and therefore it is possible to reduce the power required of the oiling device.

It may be configured that the oiling device includes: an oil pump that generates the oiling pressure; a second motor that drives the oil pump; and a second inverter that controls the rotational frequency of the second motor, in which the control unit controls the rotational frequency of the second motor such that the oiling pressure to exceeds the second abnormality pressure set value corresponding to the oiling temperature detected by the oiling temperature detecting unit.

In addition to the reduction of the power required of the oiling device because of the fact that there is no need to wastefully increase the oiling pressure of the oiling device to avoid an abnormal stop at the time of high oiling temperature, the amount of oiling can be kept to a minimum by allowing the discharge pressure of the oil pump to conform with the second abnormality pressure set value. The reduction of the amount of oiling makes it possible to operate the oil pump at low speed, and therefore it is possible to reduce the power required of the second motor that drives the oil pump and further contribute to energy saving.

The oiling device may include a valve that is provided in the passage system and adjusts the amount of oiling that is the amount of the oil fed from the oil pump to the screw compressor.

In addition to the reduction of the power required of the oiling device because of the fact that there is no need to wastefully increase the oiling pressure of the oiling device to avoid an abnormal stop at the time of high oiling temperature, the amount of oiling can be kept to a minimum. The reduction of the amount of oiling can also reduce agitation loss of oil caused by components such as a bearing and a gear wheel included in an oiling object, and therefore it is possible to contribute to energy saving.

It may be configured that the oiling device includes a heat exchanger that is provided in the passage system and causes the oil to fall in temperature by heat exchange with a cooling medium, in which the oiling temperature detecting unit includes a cooling medium temperature detecting unit that detects a cooling medium temperature that is a temperature of the cooling medium, and the control unit estimates the oiling temperature based on the cooling medium temperature detected by the cooling medium temperature detecting unit.

A second aspect of the present invention is to provide an oiling device including: a passage system that circulates and feeds oil to an oiling object driven; an oiling pressure detecting unit that detects an oiling pressure that is a pressure of the oil fed to the oiling object through the passage system; an oiling temperature detecting unit that detects an oiling temperature that is a temperature of the oil fed to the oiling object through the passage system; and a control unit, in which the control unit includes a storage unit that has stored therein a first abnormality pressure set value that differs according to the oiling temperature, the first abnormality pressure set value is set to a lower pressure as the oiling temperature is higher, and, when the oiling pressure detected by the oiling pressure detecting unit is equal to or lower than the first abnormality pressure set value corresponding to the oiling temperature detected by the oiling temperature detecting unit, the control unit considers that there is an abnormality in an oiling state and outputs a signal.

It may be configured that the control unit further executes an abnormal stop of the oiling object, and the signal output is an abnormal stop signal to stop driving of the oiling object.

A third aspect of the present invention is to provide an abnormality detection method of an oiling device, including: detecting an oiling pressure that is a pressure of oil fed from the oiling device to an oiling object driven; detecting an oiling temperature that is a temperature of the oil fed to the oiling object; and determining that there is occurrence of an abnormality in an oiling state when the oiling pressure falls below an abnormality pressure set value that differs according to the oiling temperature and is set to a lower pressure as the oiling temperature is higher.

The abnormality detection method may include stopping driving of the oiling object when it has been determined that there is the occurrence of an abnormality in an oiling state.

The abnormality detection method may include issuing an alarm of an abnormality of the oiling object when it has been determined that there is the occurrence of an abnormality in an oiling state.

Effect of the Invention

The oiling device and its abnormality detection method of the present invention can contribute to energy saving.

MODES FOR CARRYING OUT THE INVENTION

Figure 1:
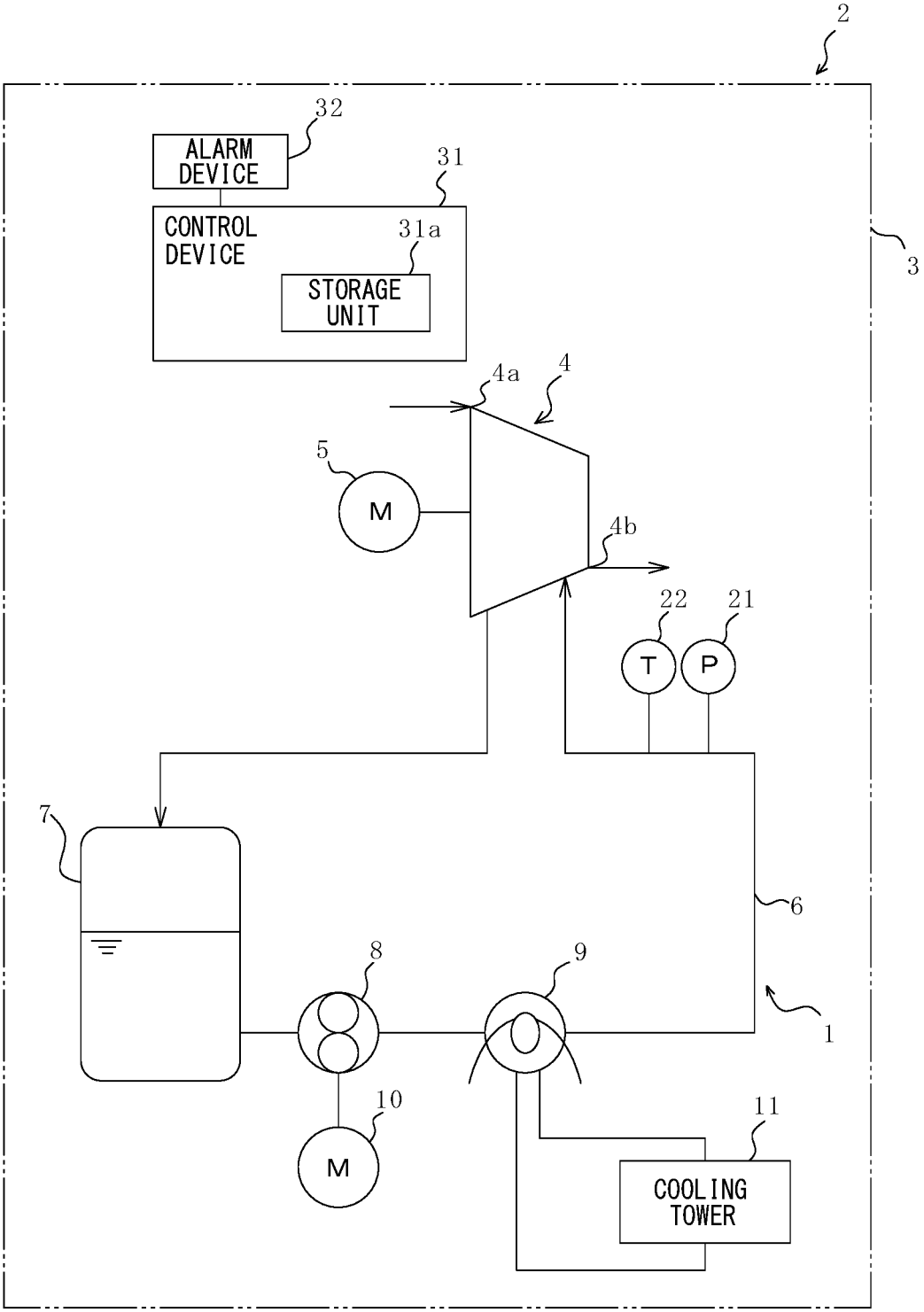
FIG. 1 is a schematic diagram of a screw compressor including an oiling device according to a first embodiment of the present invention.

Embodiments of the present invention will be described below with reference to accompanying drawings. The following descriptions and numerical values in the drawings referred to in the descriptions are merely examples, and shall not limit the technical scope of the present invention.

First Embodiment

FIG. 1 shows a compressor 2 including an oiling device 1 according to a first embodiment of the present invention. This compressor 2 is a package type, and, in the present embodiment, a compressor body (oiling object) 4 that is an oil-free screw compressor is housed, together with the oiling device 1, in a package 3.

Male and female rotors of the compressor body 4 are driven to rotate by a main motor (first motor) 5. The compressor body 4 compresses air taken in through an inlet 4*a*, and discharges the air from an outlet 4*b*.

The oiling device 1 includes a passage system 6 that circulates and feeds oil to the compressor body 4. The passage system 6 is provided with an oil tank 7, an oil pump 8, and a heat exchanger 9 from the return side from the compressor body 4. The oil pump 8 is driven by a pump motor (second motor) 10. The heat exchanger 9 in the present embodiment is a liquid-cooled type, and causes oil to fall in temperature by heat exchange with a cooling medium of liquid (for example, water). The cooling medium is cooled in a cooling tower 11. The heat exchanger 9 may be an air-cooled type to be described later with reference to FIG. 6.

Oil accumulated in the oil tank 7 is pumped by the oil pump 8 and cooled by the heat exchanger 9, and after that, it is fed to the compressor body 4. The oil from the compressor body 4 returns to the oil tank 7. In this way, the oil is circulated and fed to the compressor body 4.

In a position between the heat exchanger 9 of the passage system 6 and the compressor body 4, an oil pressure sensor (oiling pressure detecting unit) 21 and an oil temperature sensor (oiling temperature detecting unit) 22 are provided. The oil pressure sensor 21 detects oiling pressure that is pressure of oil fed to the compressor body 4 through the passage system 6. The oil temperature sensor 22 detects oiling temperature that is temperature of oil fed to the compressor body 4 through the passage system 6.

In the present embodiment, the compressor body 4 is rotated at constant speed by the main motor 5, and the oil pump 8 is rotated at constant speed by the pump motor 10.

A control device (control unit) 31 controls various devices housed in the package 3, which include the main motor 5 that drives the compressor body 4 and the pump motor 10 that drives the oil pump 8, based on various inputs including an oiling pressure input from the oil pressure sensor 21 and an oiling temperature input from the oil temperature sensor 22.

An alarm device 32 is connected to the control device 31. The alarm device 32 sends out an abnormality alarm such as a sound or a visual display based on a command from the control device 31.

The control device 31 has an abnormality alarm function of outputting a signal to cause the alarm device 32 to send out an alarm when the oiling pressure has become equal to or lower than a predetermined abnormality detection pressure (second abnormality pressure set value) and an abnormal stop function of outputting a signal (abnormal stop signal) to cause the main motor 5 to stop the compressor body 4 when the oiling pressure has fallen below a predetermined abnormal stop pressure (first abnormality pressure set value).

To realize the abnormality alarm function and the abnormal stop function, the control device 31 includes a storage unit 31*a* that stores therein the abnormality detection pressure and the abnormal stop pressure. When performing the abnormality alarm function and the abnormal stop function, the control device 31 refers to the storage unit 31*a*.

Figure 2:
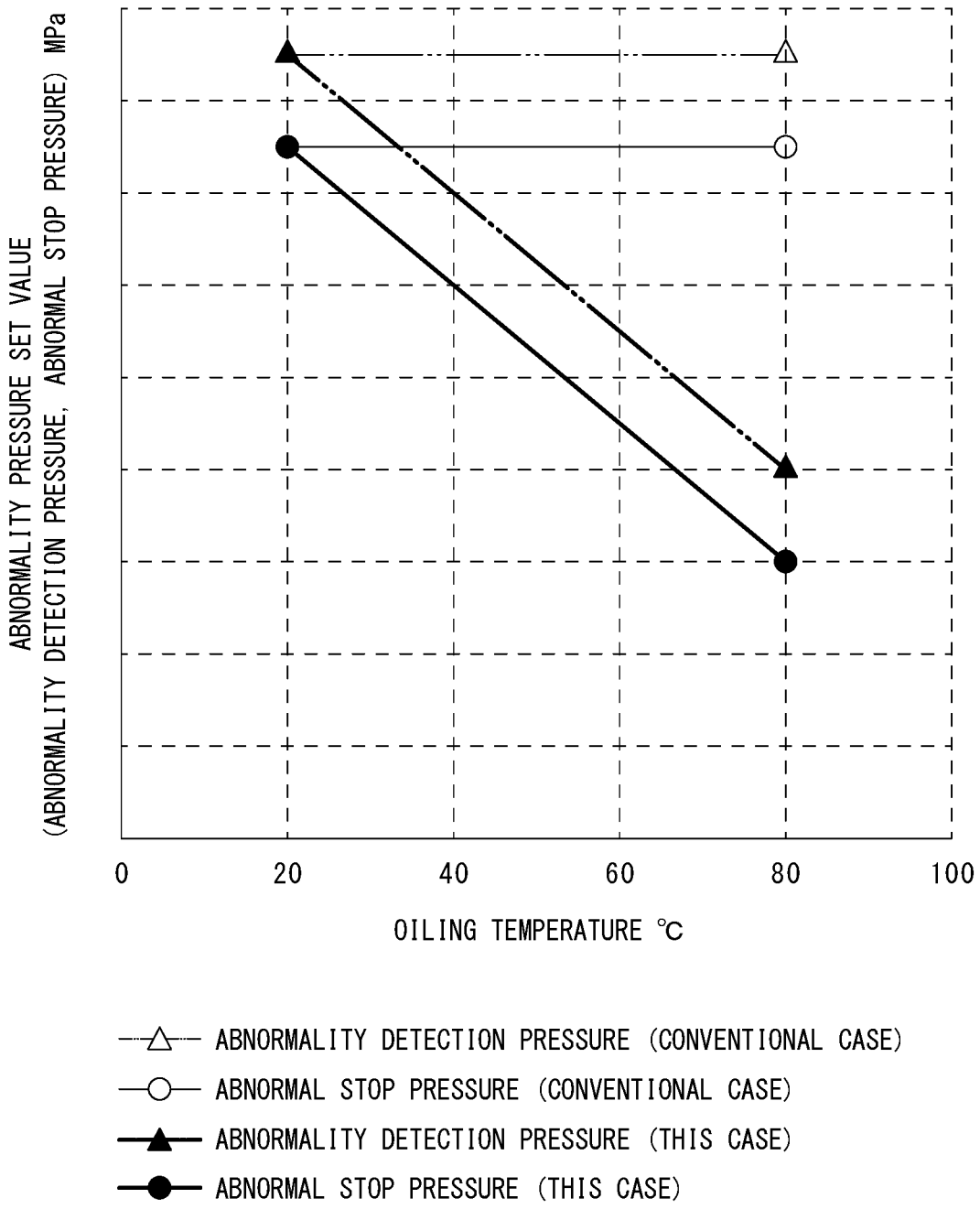
FIG. 2 is a graph showing a relationship between abnormality detection pressure and abnormal stop pressure and oiling temperature in the first embodiment.

Thick lines in FIG. 2 show the abnormality detection pressure and the abnormal stop pressure that have been stored in the storage unit 31*a*. Thin lines in the same drawing show conventional abnormality detection pressure and conventional abnormal stop pressure. The conventional abnormality detection pressure and the conventional abnormal stop pressure are constant regardless of oiling temperature. On the other hand, the abnormality detection pressure and the abnormal stop pressure in the present embodiment are both a function having a negative correlation with an increase in oiling temperature, and, as for the same oiling temperature, the abnormal stop pressure is a lower pressure than the abnormality detection pressure. This function is a linear function in the present embodiment; however, as long as the abnormality detection pressure and the abnormal stop pressure have a negative correlation with an increase in oiling temperature, it may be another function. In a case of the same oiling temperature, the abnormality detection pressure is a higher pressure than the abnormal stop pressure.

The control device 31 causes the alarm device 32 to send out an alarm if the oiling pressure detected by the oil pressure sensor 21 is equal to or lower than an abnormality detection pressure corresponding to the oiling temperature detected by the oil temperature sensor 22.

Furthermore, the control device 31 causes the compressor body 4, more specifically, the main motor 5 to stop if the oiling pressure detected by the oil pressure sensor 21 is equal to or lower than an abnormal stop pressure corresponding to the oiling temperature detected by the oil temperature sensor 22.

In a case where the oil temperature is high, because of a decrease in the viscosity of oil, the oiling pressure required to ensure the same amount of oiling is lowered as compared with in a case where the oil temperature is low. The higher the oiling temperature is, the lower the abnormal stop pressure stored in the storage unit 31*a* of the control unit 31 is set to; therefore, it does not happen that when the oiling temperature is high, the oiling pressure of the oiling device 1 is high, and oil is overfed even though the necessary amount of oiling has been ensured to avoid an abnormal stop of the compressor body 4. In this way, it is possible to avoid overfeeding of oil at the time of high oil temperature, and therefore it is possible to reduce power required of the oiling device 1 (more specifically, the pump motor 10) and contribute to energy saving.

FIGS. 3 to 6 show modification examples of the first embodiment.

Figure 3:
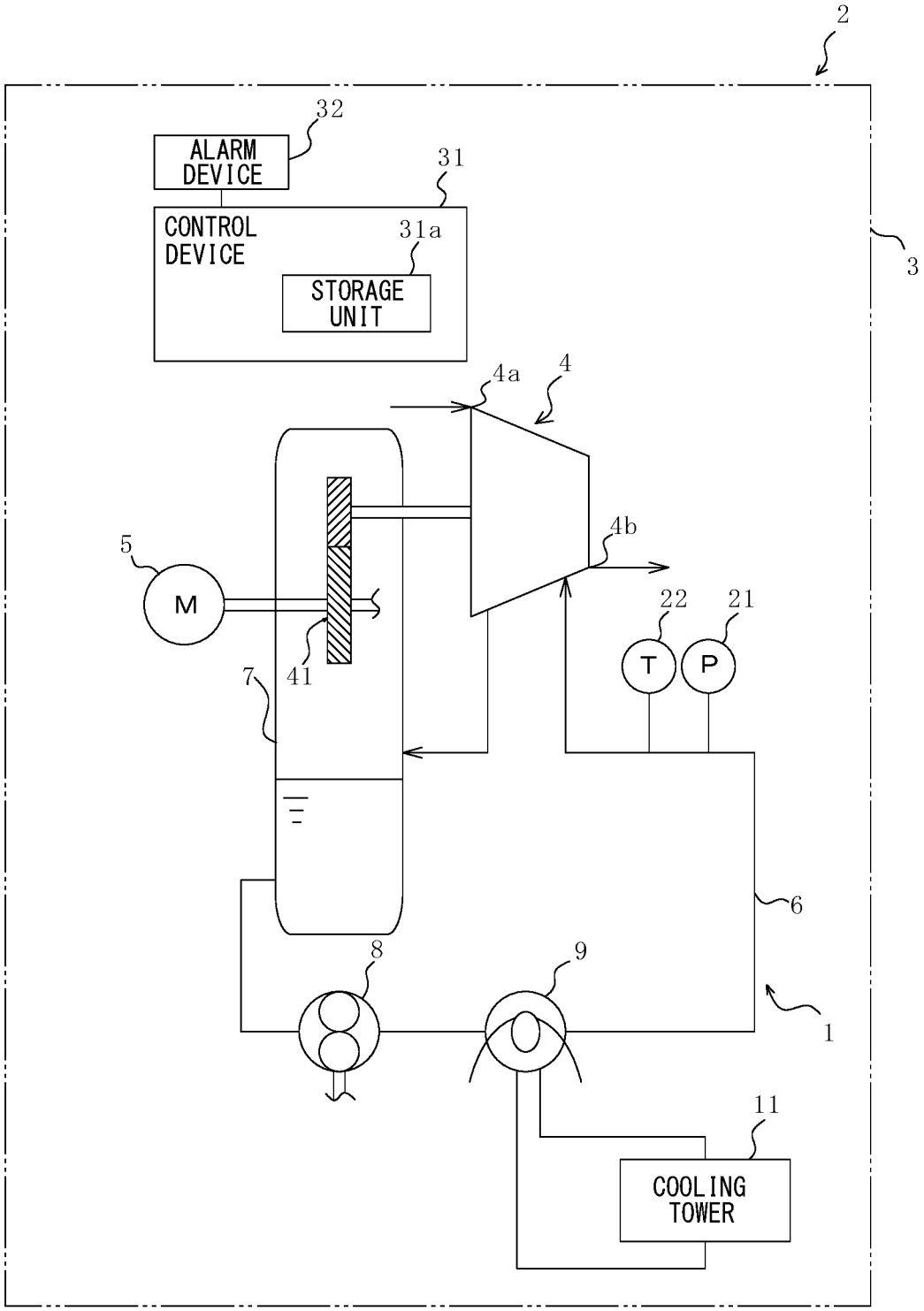
FIG. 3 is a schematic diagram of the screw compressor including an oiling device of a modification example of the first embodiment.

In the modification example of FIG. 3, the oil pump 8 is driven by the main motor 5, thereby generating the oiling pressure. In this example, the power of the main motor 5 is transmitted to the compressor body 4 through a pair of gears 41.

Figure 4:
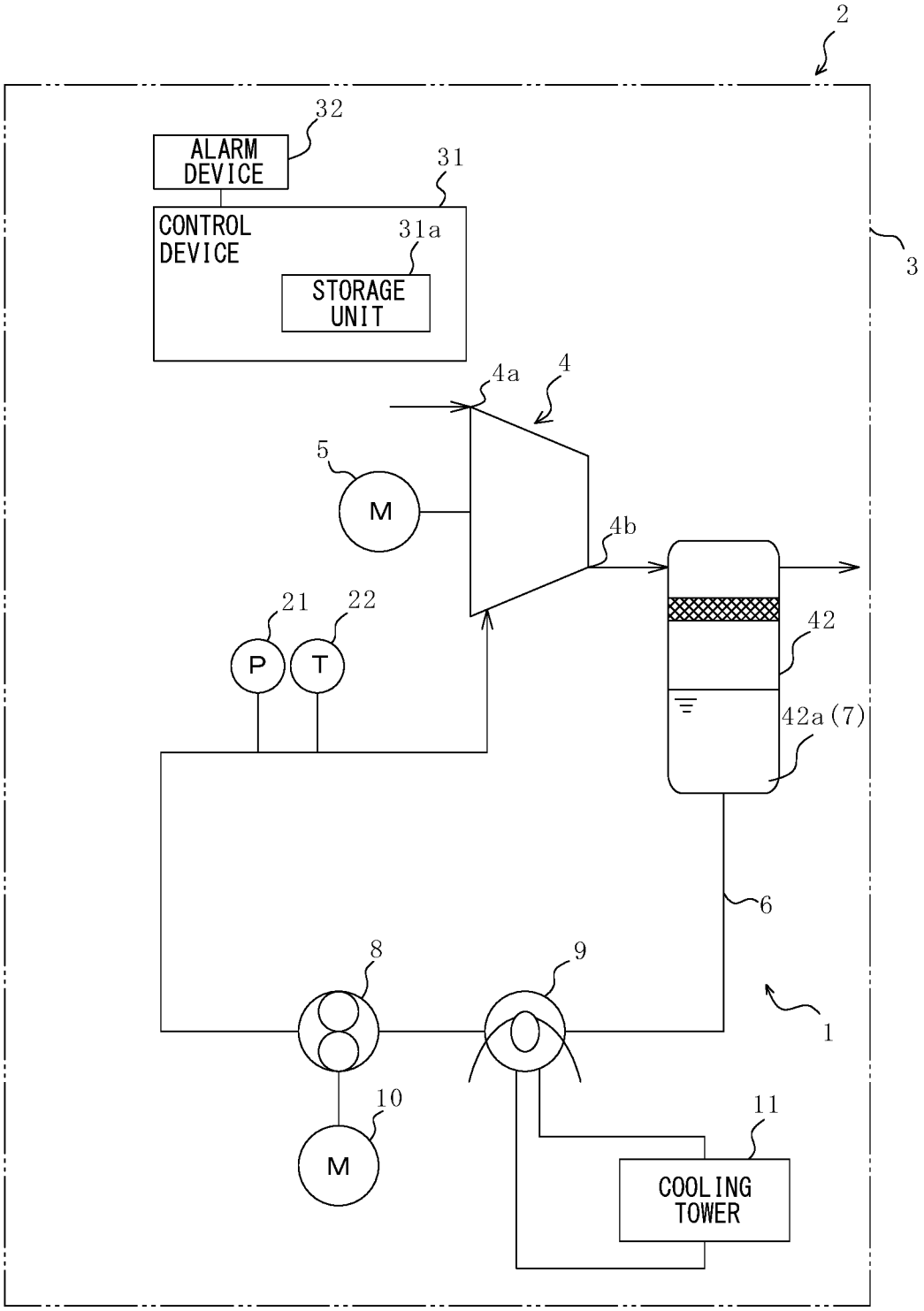
FIG. 4 is a schematic diagram of the screw compressor including an oiling device of a modification example of the first embodiment.

In the modification example of FIG. 4, the compressor body 4 is an oil-injected screw compressor. Compressed air discharged from the outlet 4*b* of the compressor body 4 is sent to the downstream side after oil is separated in an oil separator/collector 42. The separated oil is accumulated in an oil reservoir 42*a* on the bottom of the oil separator/collector 42. The oil accumulated in the oil reservoir 42*a* is pumped into the compressor body 4 by the oil pump 8. That is, the oil reservoir 42*a* on the bottom of the oil separator/collector 42 serves as the oil tank 7.

Figure 5:
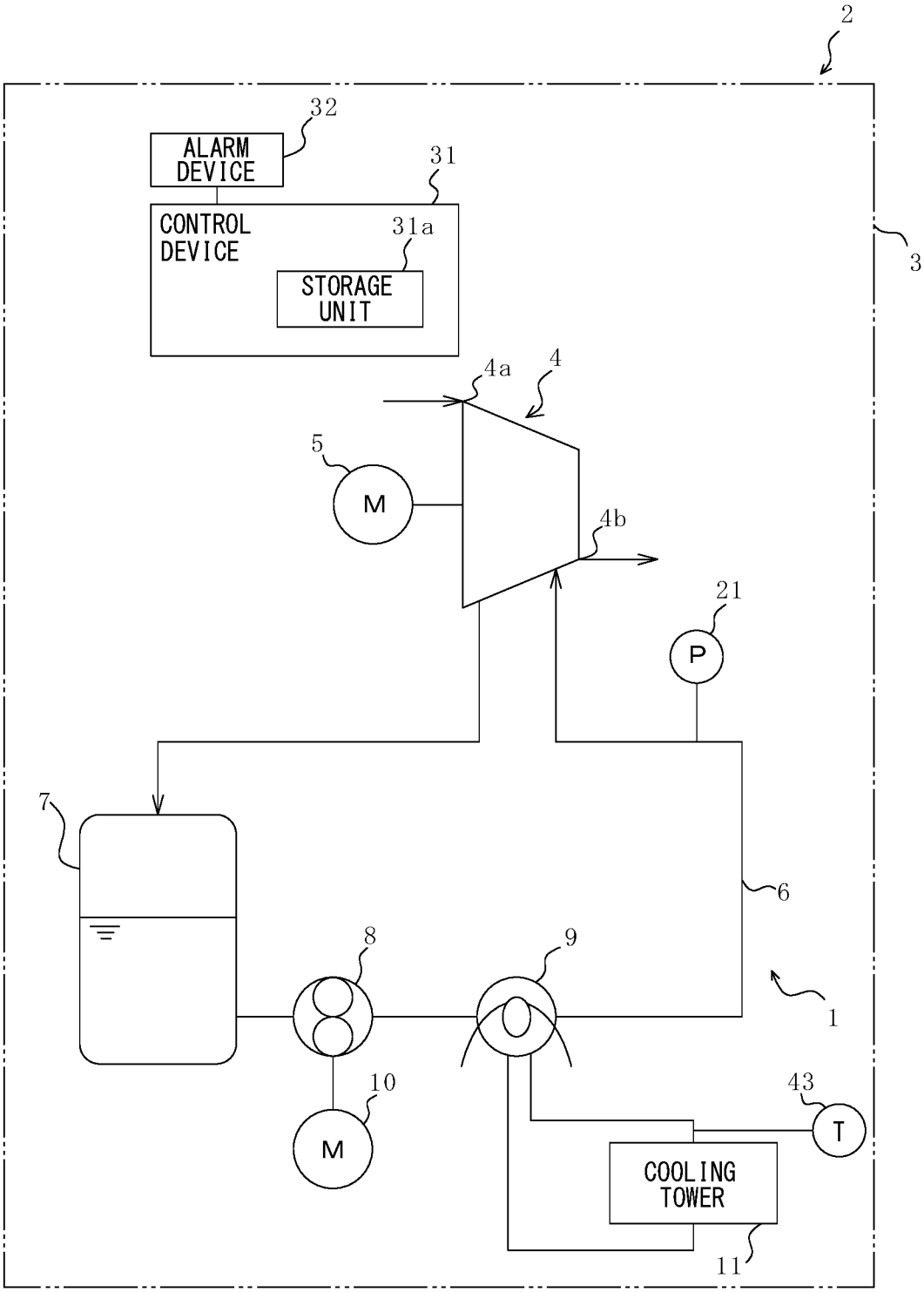
FIG. 5 is a schematic diagram of the screw compressor including an oiling device of a modification example of the first embodiment.

In the modification example shown in FIG. 5, instead of the oil temperature sensor 22, a cooling medium temperature sensor 43 that detects temperature of the cooling medium of the liquid-cooled heat exchanger 9 (which may be temperature before the heat exchange with the oil) is provided. The control device 31 estimates the oiling temperature based on the cooling medium temperature detected by the cooling medium temperature sensor 43.

Figure 6:
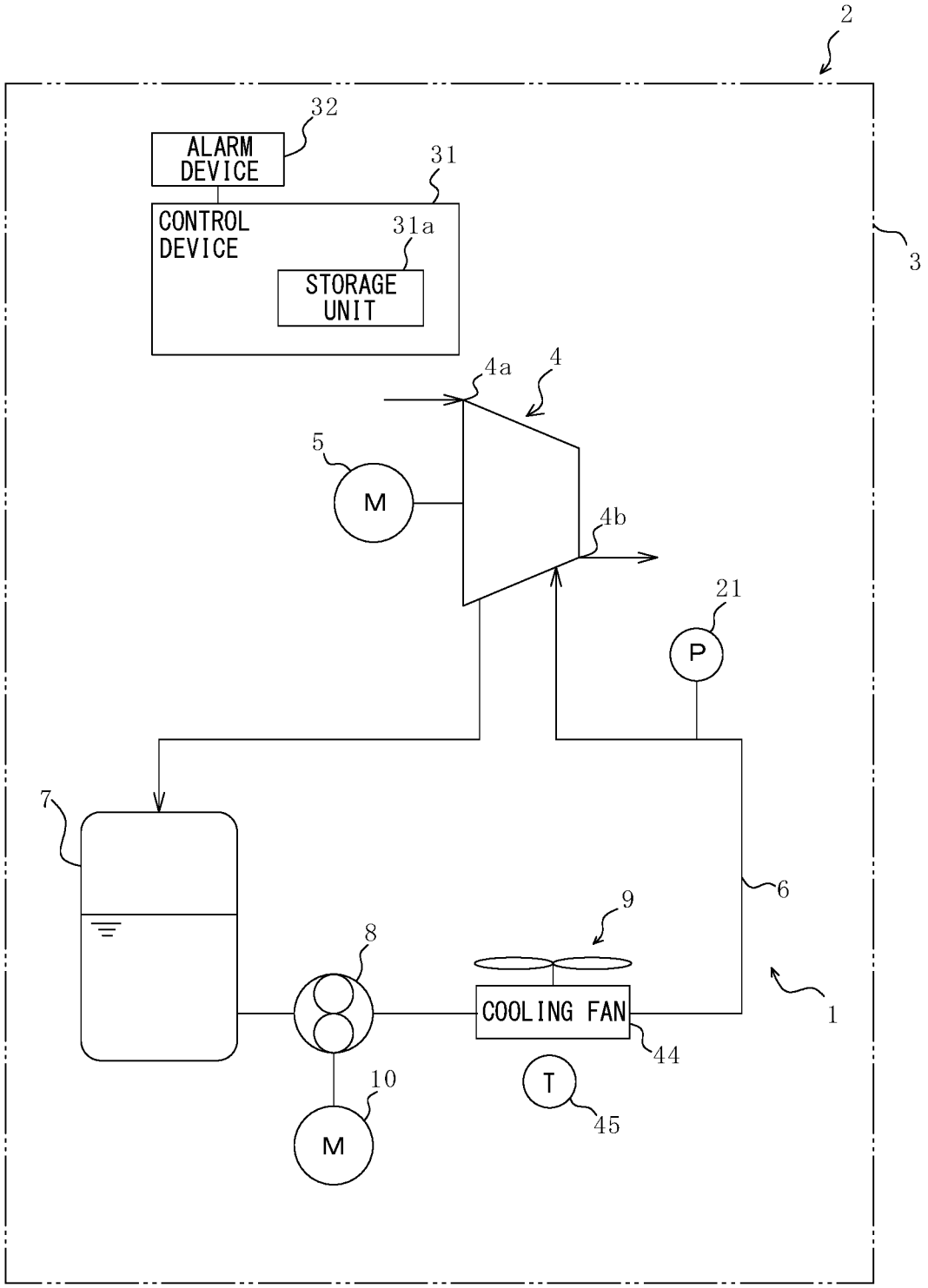
FIG. 6 is a schematic diagram of the screw compressor including an oiling device of a modification example of the first embodiment.

In the modification example shown in FIG. 6, the heat exchanger 9 is an air-cooled type, and causes oil to fall in temperature by heat exchange with cooling air (gaseous cooling medium) generated by a cooling fan 44. In this modification example, instead of the oil temperature sensor 22, a cooling air temperature sensor 45 that detects temperature of the cooling air (which may be temperature before the heat exchange with the oil) is provided. The control device 31 estimates the oiling temperature based on the cooling air temperature detected by the cooling air temperature sensor 45.

A configuration in which the control device 31 estimates the oiling temperature from the temperature detected by the cooling medium temperature sensor 43 or the cooling air temperature sensor 45 instead of the oil temperature sensor 22 can be adopted in below-described second to seventh embodiments as well.

The second to seventh embodiments are described below. In these embodiments, points not specifically mentioned are similar to those in the first embodiment or its modification examples. Furthermore, in the drawings relating to these, the same components as those in the first embodiment and its modification examples are assigned the same reference numerals.

Second Embodiment

Figure 7:
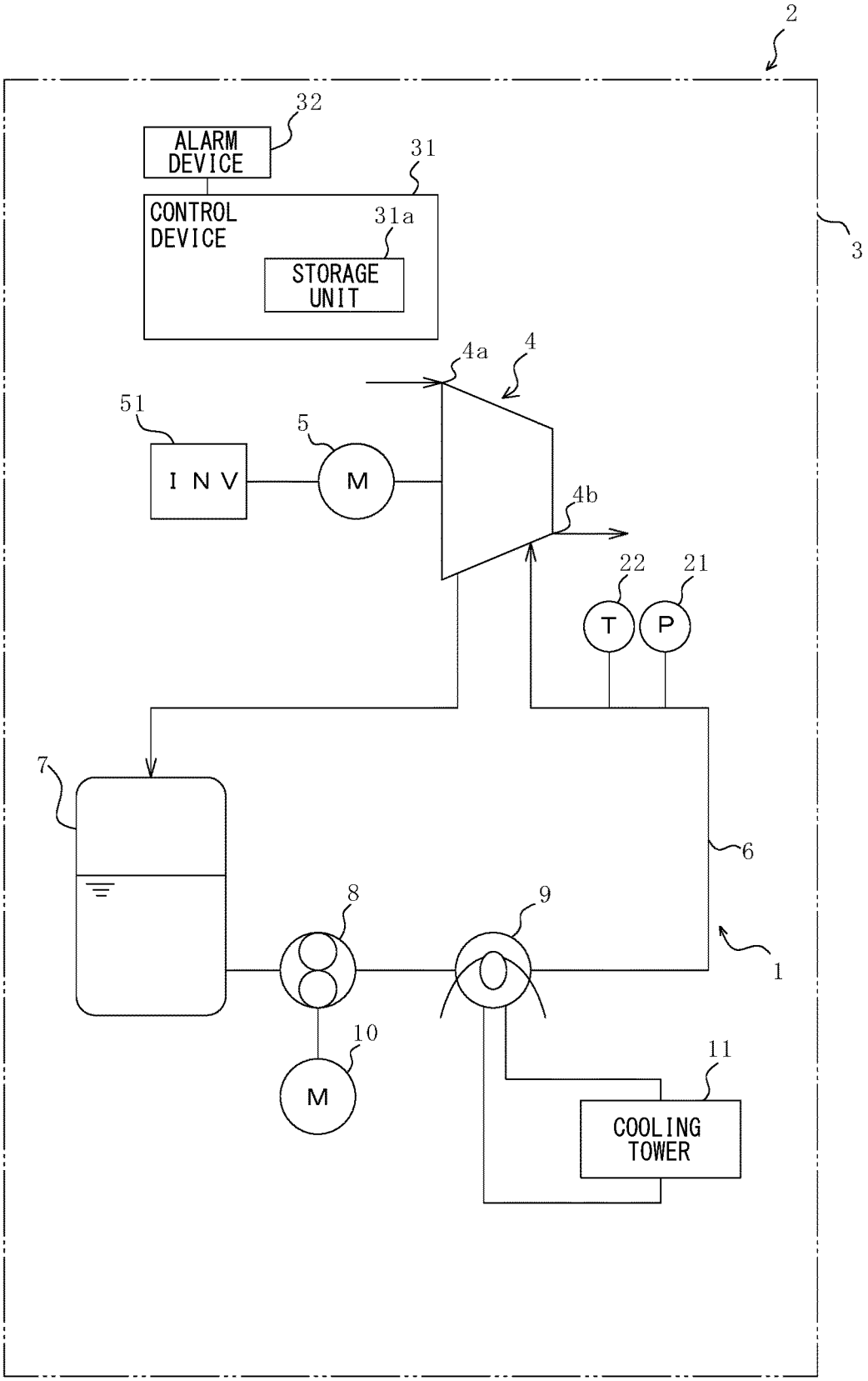
FIG. 7 is a schematic diagram of a screw compressor including an oiling device according to a second embodiment of the present invention.

In the second embodiment of the present invention shown in FIG. 7, the compressor body 4 includes an inverter (first inverter) 51 for controlling the rotational frequency of the main motor 5.

The storage unit 31*a* of the control device 31 has stored therein a relationship between the rotational frequency of the main motor 5 and the abnormality detection pressure as a plurality of functions specified according to at least two kinds of oiling temperatures (one lower than a threshold temperature of Tth° C. and the other equal to or higher than the threshold temperature of Tth° C.).

Figure 8:
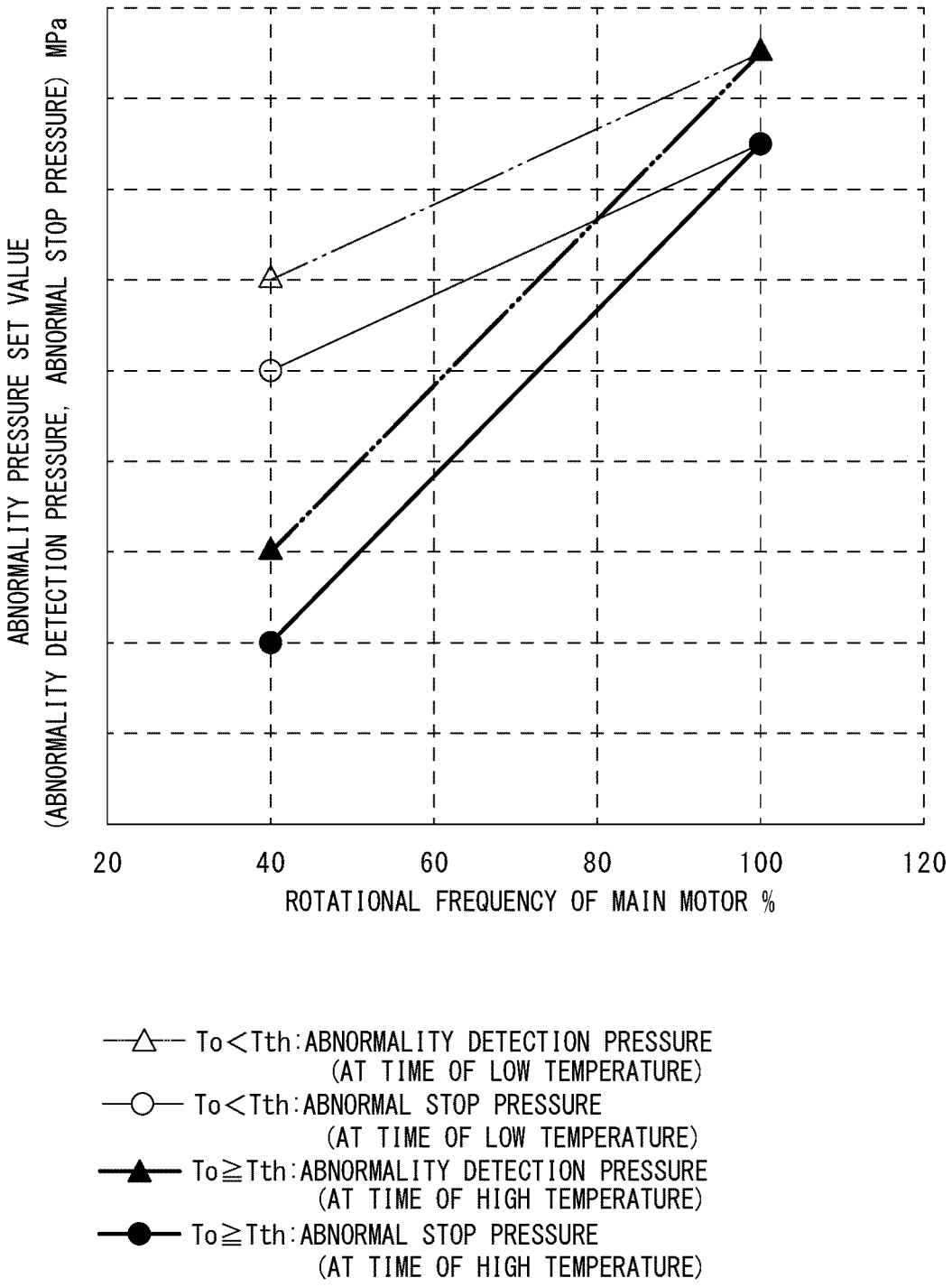
FIG. 8 is a graph showing a relationship between abnormality detection pressure and abnormal stop pressure and rotational frequency of a main motor in the second embodiment.

With reference to FIG. 8, a relationship between the rotational frequency of the main motor 5 and the abnormality detection pressure in a case where the oiling temperature is a relatively low temperature (hereinafter sometimes referred to as lower than the threshold temperature of Tth° C.) is a function having a positive correlation with the rotational frequency of the main motor 5 (thin two-dot chain line). This function is a linear function in the present embodiment; however, as long as the abnormality detection pressure has a positive correlation with the rotational frequency of the main motor 5, it may be another function. Furthermore, a relationship between the rotational frequency of the main motor 5 and the abnormality detection pressure in a case where the oiling temperature is a relatively high temperature (hereinafter sometimes referred to as equal to or higher than the threshold temperature of Tth° C.) is a linear function having a positive correlation with the rotational frequency of the main motor 5 (thick two-dot chain line). This function is also a linear function in the present embodiment; however, as long as the abnormality detection pressure has a positive correlation with the rotational frequency of the main motor 5, it may be another function. As for the same rotational frequency, the abnormality detection pressure at the time of the relatively high temperature is a lower pressure than the abnormality detection pressure at the time of the relatively low temperature.

With continuously reference to FIG. 8, a relationship between the rotational frequency of the main motor 5 and the abnormal stop pressure in a case where the oiling temperature is a relatively low temperature (lower than the threshold temperature of Tth° C.) is a function having a positive correlation with the rotational frequency of the main motor 5 (thin solid line). This function is a linear function in the present embodiment; however, as long as the abnormal stop pressure has a positive correlation with the rotational frequency of the main motor 5, it may be another function. A relationship between the rotational frequency of the main motor 5 and the abnormal stop pressure in a case where the oiling temperature is a relatively high temperature (equal to or higher than the threshold temperature of Tth° C.) is also a function having a positive correlation with the rotational frequency of the main motor 5 (thick solid line). This function is a linear function in the present embodiment;

however, as long as the abnormal stop pressure has a positive correlation with the rotational frequency of the main motor 5, it may be another function. The abnormal stop pressure in a case where the rotational frequency of the main motor 5 is rated at 100% is the same as in a case where the oiling temperature is lower than the threshold temperature of Tth° C. However, the angle of inclination of the function in the case where the oiling temperature is equal to or higher than the threshold temperature of Tth° C. is greater than in the case where the oiling temperature is lower than the threshold temperature of Tth° C.; the lower the rotational frequency of the main motor 5, the lower the abnormal stop pressure as compared with the case where the oiling temperature is lower than the threshold temperature of Tth° C. That is, except the case where the rotational frequency of the main motor 5 is rated at 100%, the abnormal stop pressure in the case where the oiling temperature is equal to or higher than the threshold temperature of Tth° C. is a lower pressure than in the case where the oiling temperature is lower than the threshold temperature of Tth° C.

In the present embodiment, when the oiling temperature becomes equal to or higher than the threshold temperature of Tth° C., the function that defines the relationship between the rotational frequency of the main motor 5 and the abnormal stop pressure or the abnormality detection pressure is switched. More specifically, when the oiling temperature has become equal to or higher than the threshold temperature of Tth° C., the inclination of the function is changed. In addition to or instead of this technique, the function may be changed using the oiling temperature as a variable.

In a case where the oiling temperature is separated into high temperature and low temperature relative to the threshold temperature of Tth° C. as in the present embodiment, the threshold temperature of Tth° C. may be set, for example, in a range of relatively high temperatures within a temperature range of 0° C. to 60° C.

By defining the relationship between the rotational frequency of the main motor 5 and the abnormal stop pressure as a plurality of functions that allow the abnormal stop pressure to become low pressure when the oiling temperature is high as in the present embodiment, the oiling pressure of the oiling device 1 at each of different rotational frequencies of the main motor 5 does not have to be wastefully increased to avoid an abnormal stop at the time of high oiling temperature, and thus the power required of the oiling device 1 can be reduced.

Figure 9:
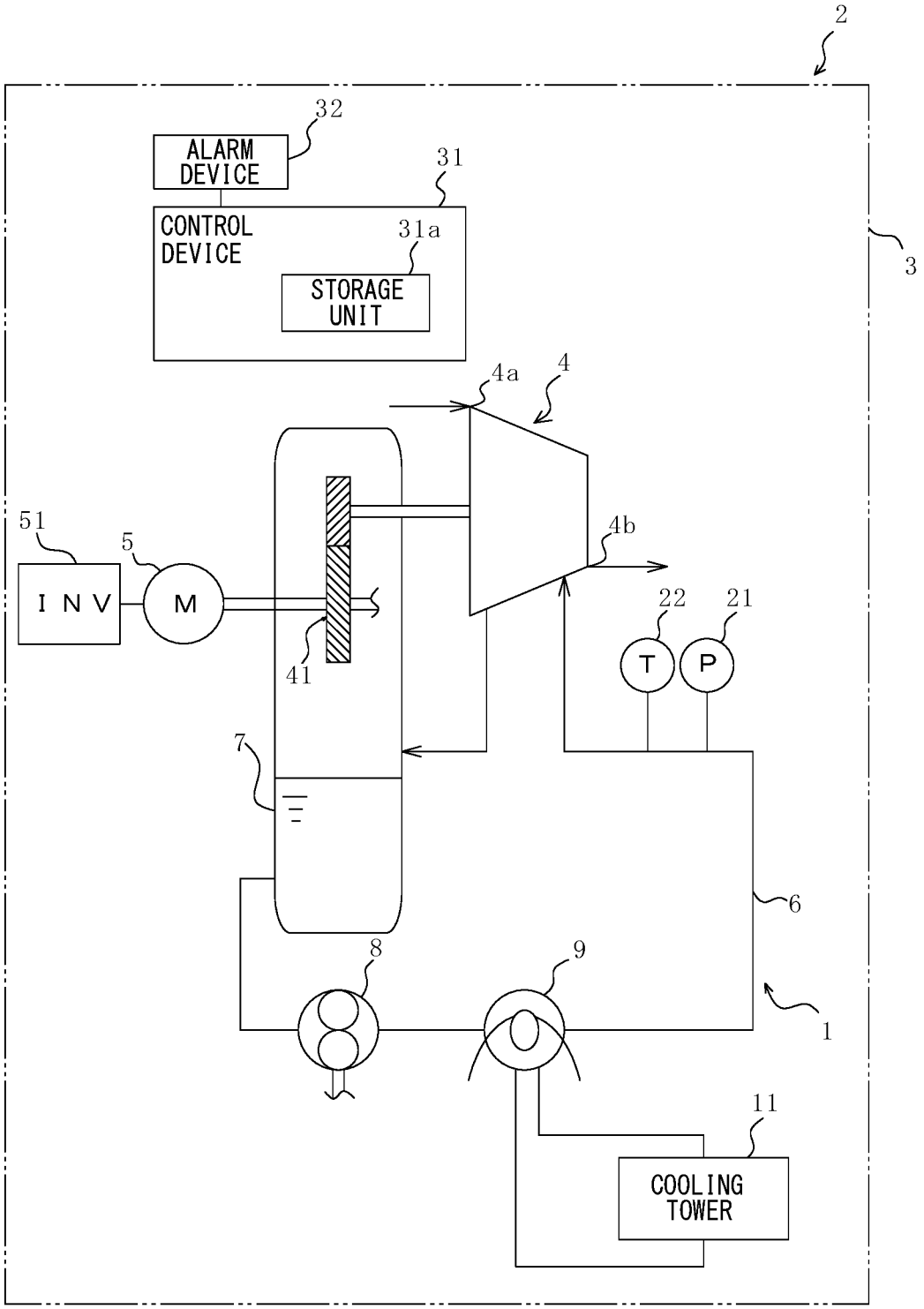
FIG. 9 is a schematic diagram of the screw compressor including an oiling device of a modification example of the second embodiment.
Figure 10:
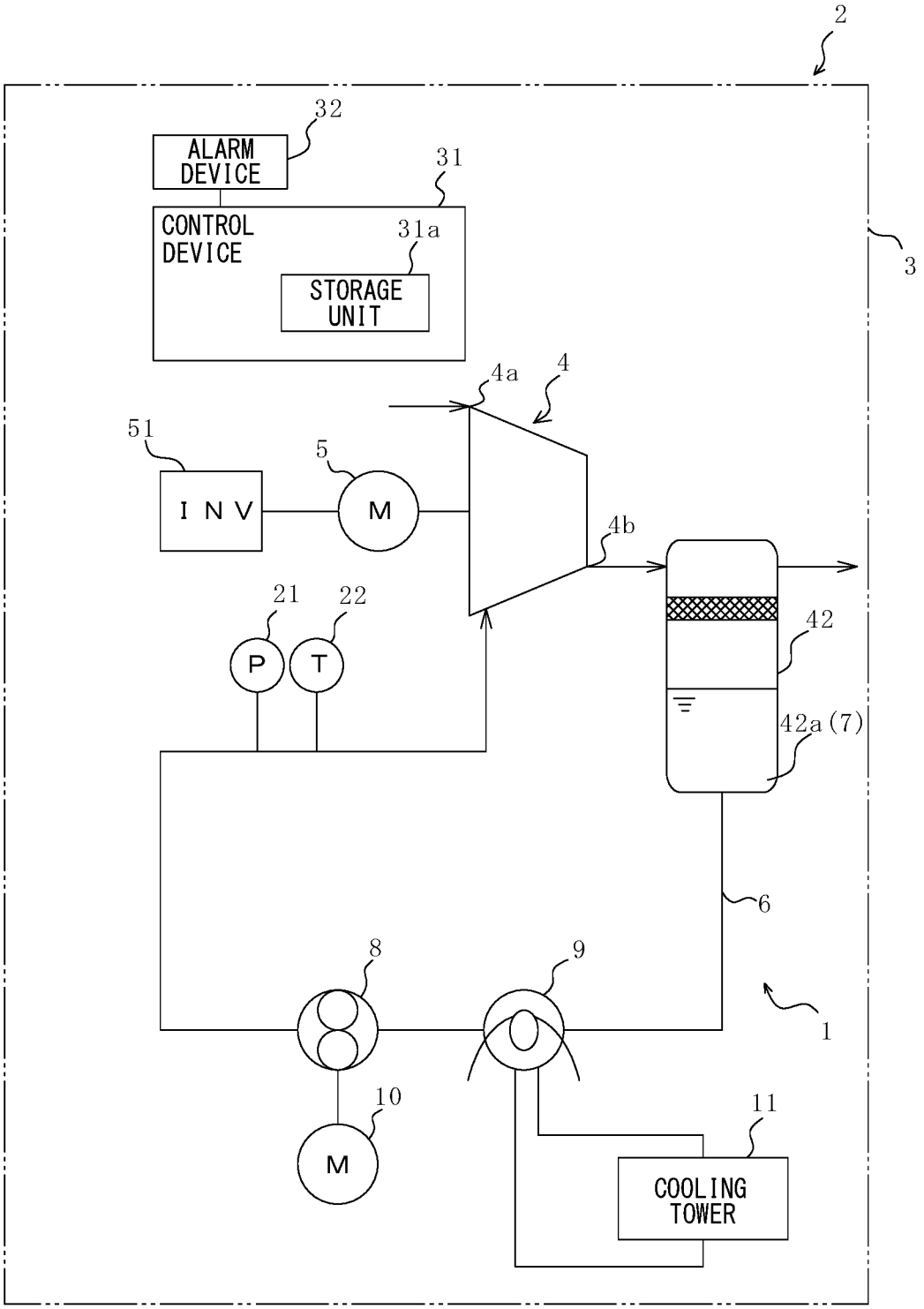
FIG. 10 is a schematic diagram of the screw compressor including an oiling device of a modification example of the second embodiment.

FIGS. 9 and 10 are modification examples of the second embodiment. In the modification example of FIG. 9, the oil pump 8 is driven by the main motor 5, thereby generating the oiling pressure, and the rotational frequency of the main motor 5 is controlled by the inverter 51. In the modification example of FIG. 10, the compressor body 4 is an oil-injected screw compressor, and the rotational frequency of the main motor 5 is controlled by the inverter 51. Even in configurations as in FIGS. 9 and 10, in a case where the rotational frequency of the main motor 5 is controlled by the inverter 51, the abnormality detection pressure and the abnormal stop pressure can be set as shown in FIG. 8.

Third Embodiment

Mechanical configurations of the oiling device 1 and the compressor body 4 in the third embodiment of the present invention are the same as the second embodiment (FIG. 7) or its modification examples (FIGS. 9 and 10). The present embodiment differs from the second embodiment in the abnormality detection pressure and the abnormal stop pressure that have been stored in the storage unit 31*a* of the control device 31.

Figure 11:
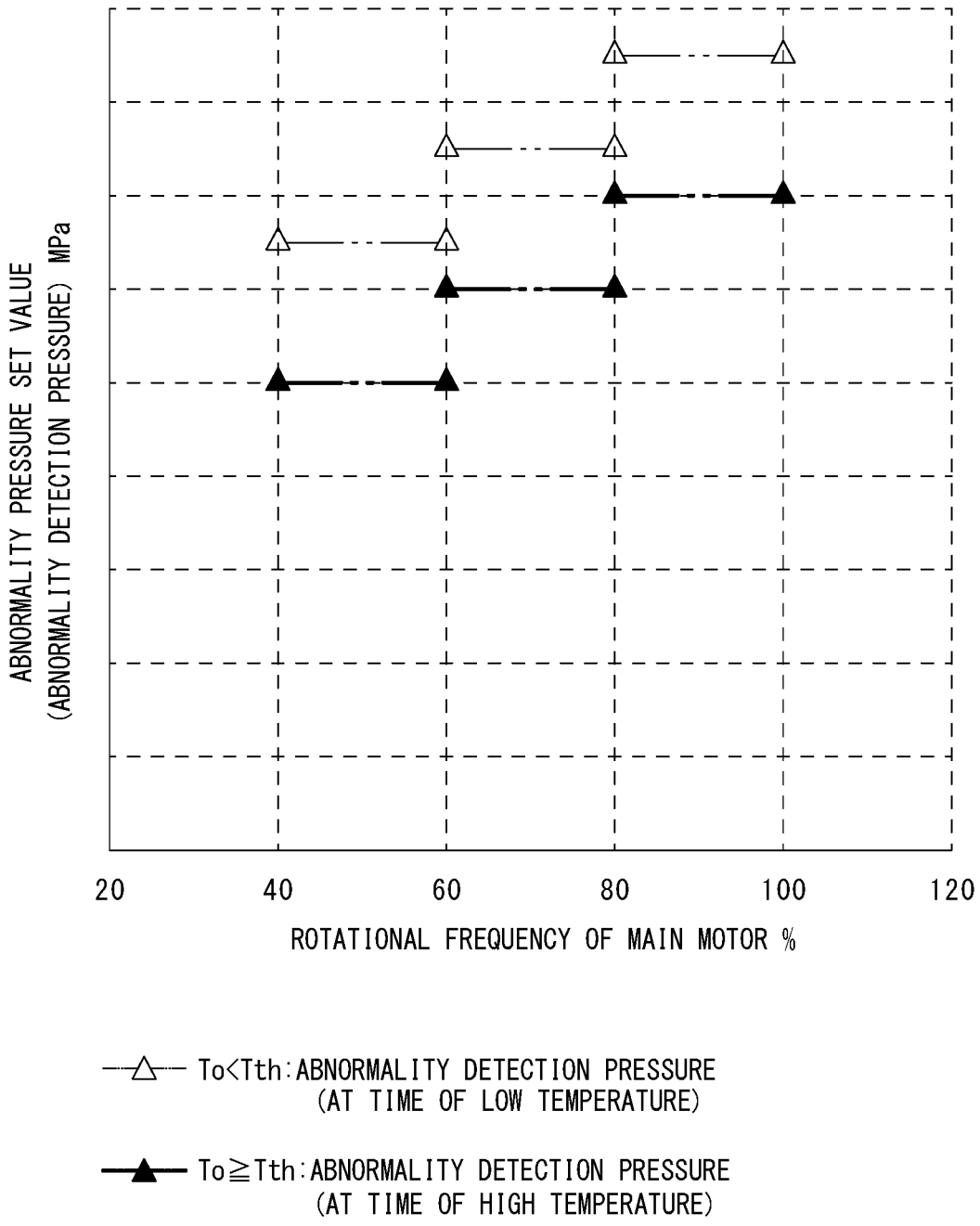
FIG. 11 is a graph showing a relationship between the rotational frequency of the main motor and the abnormality detection pressure according to a third embodiment of the present invention.

With reference to FIG. 11, a relationship between the rotational frequency of the main motor 5 and the abnormality detection pressure in a case where the oiling temperature is a relatively low temperature (lower than the threshold temperature of Tth° C.) is set so that the abnormality detection pressure falls in a stepwise fashion with decrease in the rotational frequency of the main motor 5 on the basis of a case where the rotational frequency of the main motor 5 is the rated rotational frequency (thin two-dot chain line). Specifically, the abnormality detection pressure is a constant value while the rotational frequency of the main motor 5 is between 100% and 80% of the rated rotational frequency, and is constant at a value lower than the constant value while it is between 80% and 60%, and further falls and remains constant while it is between 60% and 40%. Likewise, a relationship between the rotational frequency of the main motor 5 and the abnormality detection pressure in a case where the oiling temperature is a relatively high temperature (equal to or higher than the threshold temperature of Tth° C.) is also set so that the abnormality detection pressure falls in a stepwise fashion with decrease in the rotational frequency of the main motor 5 on the basis of the case where the rotational frequency of the main motor 5 is the rated rotational frequency (thick two-dot chain line). Specifically, the abnormality detection pressure is a constant value while the rotational frequency of the main motor 5 is between 100% and 80% of the rated rotational frequency, and is constant at a value lower than the constant value while it is between 80% and 60%, and further falls and remains constant while it is between 60% and 40%. As for the same rotational frequency range (100% to 80%, 80% to 60%, 60% to 40%), the abnormality detection pressure in the case where the oiling temperature is a relatively high temperature (equal to or higher than the threshold temperature of Tth° C.) is a lower pressure than the abnormality detection pressure in the case where the oiling temperature is a relatively low temperature (lower than the threshold temperature of Tth° C.).

Figure 12:
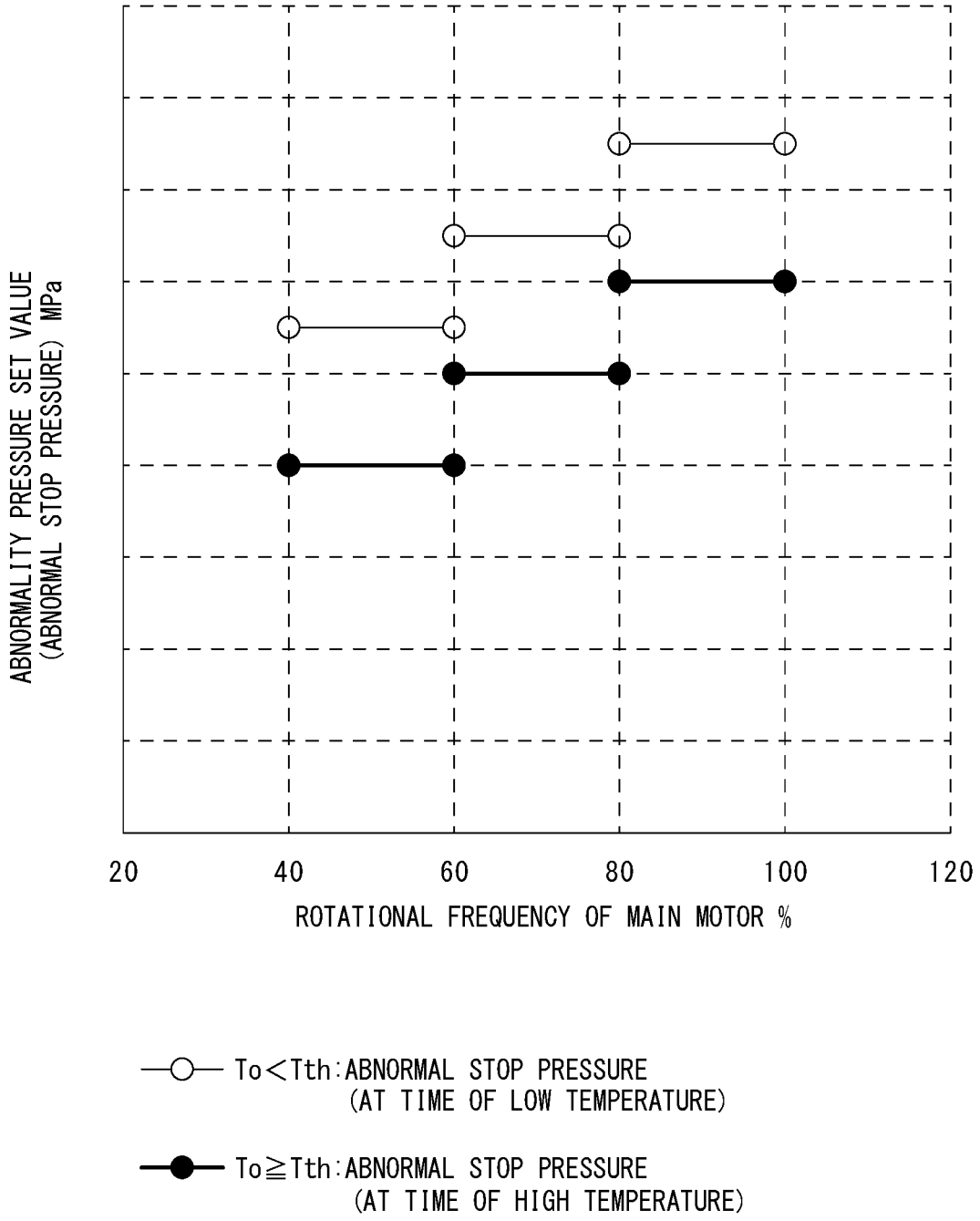
FIG. 12 is a graph showing a relationship between the rotational frequency of the main motor and the abnormal stop pressure in an oiling device according to the third embodiment of the present invention.

With reference to FIG. 12, a relationship between the rotational frequency of the main motor 5 and the abnormal stop pressure in a case where the oiling temperature is a relatively low temperature (lower than the threshold temperature of Tth° C.) is set so that the abnormal stop pressure falls in a stepwise fashion with decrease in the rotational frequency of the main motor 5 on the basis of a case where the rotational frequency of the main motor 5 is the rated rotational frequency (thin solid line). Specifically, the abnormal stop pressure is a constant value while the rotational frequency of the main motor 5 is between 100% and 80% of the rated rotational frequency, and is constant at a value lower than the constant value while it is between 80% and 60%, and further falls and remains constant while it is between 60% and 40%. Likewise, a relationship between the rotational frequency of the main motor 5 and the abnormal stop pressure in a case where the oiling temperature is a relatively high temperature (equal to or higher than the threshold temperature of Tth° C.) is also set so that the abnormal stop pressure falls in a stepwise fashion with decrease in the rotational frequency of the main motor 5 on the basis of the case where the rotational frequency of the main motor 5 is the rated rotational frequency (thick solid line). Specifically, the abnormal stop pressure is a constant value while the rotational frequency of the main motor 5 is between 100% and 80% of the rated rotational frequency, and is constant at a value lower than the constant value while it is between 80% and 60%, and further falls and remains constant while it is between 60% and 40%. As for the same rotational frequency range (100% to 80%, 80% to 60%, 60% to 40%), the abnormal stop pressure in the case where the oiling temperature is a relatively high temperature (equal to or higher than the threshold temperature of Tth° C.) is a lower pressure than the abnormal stop pressure in the case where the oiling temperature is a relatively low temperature (lower than the threshold temperature of Tth° C.). Furthermore, as for the same rotational frequency range (100% to 80%, 80% to 60%, 60% to 40%), the abnormal stop pressure is a lower pressure than the abnormality detection pressure.

By setting the relationship between the rotational frequency of the main motor 5 and the abnormal stop pressure so that the abnormal stop pressure becomes low pressure when the oiling temperature is high as in the present embodiment, the oiling pressure of the oiling device 1 at each of different rotational frequencies of the main motor 5 does not have to be wastefully increased to avoid an abnormal stop at the time of high oiling temperature, and thus the power required of the oiling device 1 can be reduced.

In the present embodiment, the abnormal stop pressure and the abnormality detection pressure are set to fall in a stepwise fashion in three steps with decrease in the rotational frequency of the main motor 5 on the basis of the rated rotational frequency of the main motor 5; however, they may be set to fall in two steps, or may be set to fall in four or more steps.

Fourth Embodiment

Mechanical configurations of the oiling device 1 and the compressor body 4 in the fourth embodiment of the present invention are the same as the second embodiment (FIG. 7) or its modification examples (FIGS. 9 and 10). The present embodiment differs from the second embodiment in the abnormal stop pressure that has been stored in the storage unit 31*a* of the control device 31.

Figure 13:
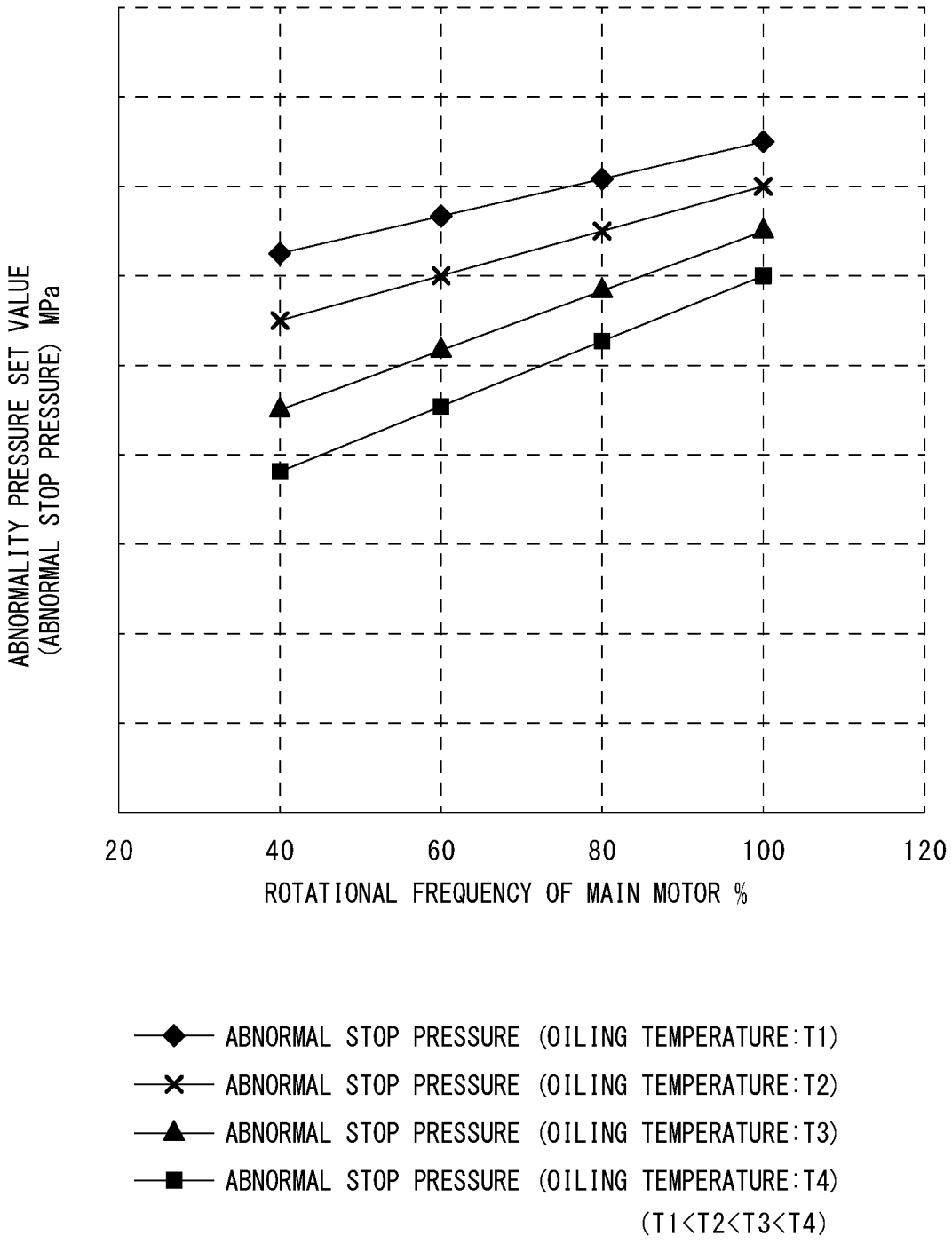
FIG. 13 is a graph showing a relationship between the rotational frequency of the main motor and the abnormal stop pressure in an oiling device according to a fourth embodiment of the present invention.

With reference to FIG. 13, a relationship between the rotational frequency of the main motor 5 and the abnormal stop pressure is set by a function having a positive correlation with the rotational frequency of the main motor 5 with respect to each of a plurality of oiling temperatures (in the present embodiment, T1° C., T2° C., T3° C., and T4° C. in a relationship of T1<T2<T3<T4). This function is a linear function in the present embodiment; however, as long as the abnormal stop pressure has a positive correlation with the rotational frequency of the main motor, it may be another function. Furthermore, a relationship among those functions is set so that the higher the oiling temperature, the lower the abnormal stop pressure. Because of these settings, the oiling pressure of the oiling device 1 at each of different rotational frequencies of the main motor 5 does not have to be wastefully increased to avoid an abnormal stop at the time of high oiling temperature, and thus the power required of the oiling device 1 can be reduced.

In the present embodiment, the functions defining the relationship between the rotational frequency of the main motor 5 and the abnormal stop pressure are set with respect to four kinds of temperatures; furthermore, similar functions may be set with respect to two kinds, three kinds, or five or more kinds of temperatures. Moreover, also as for the abnormality detection pressure, as with the abnormal stop pressure, the relationship may be set by a function having a positive correlation with the rotational frequency of the main motor 5 with respect to a plurality of oiling temperatures.

Fifth Embodiment

Figure 14:
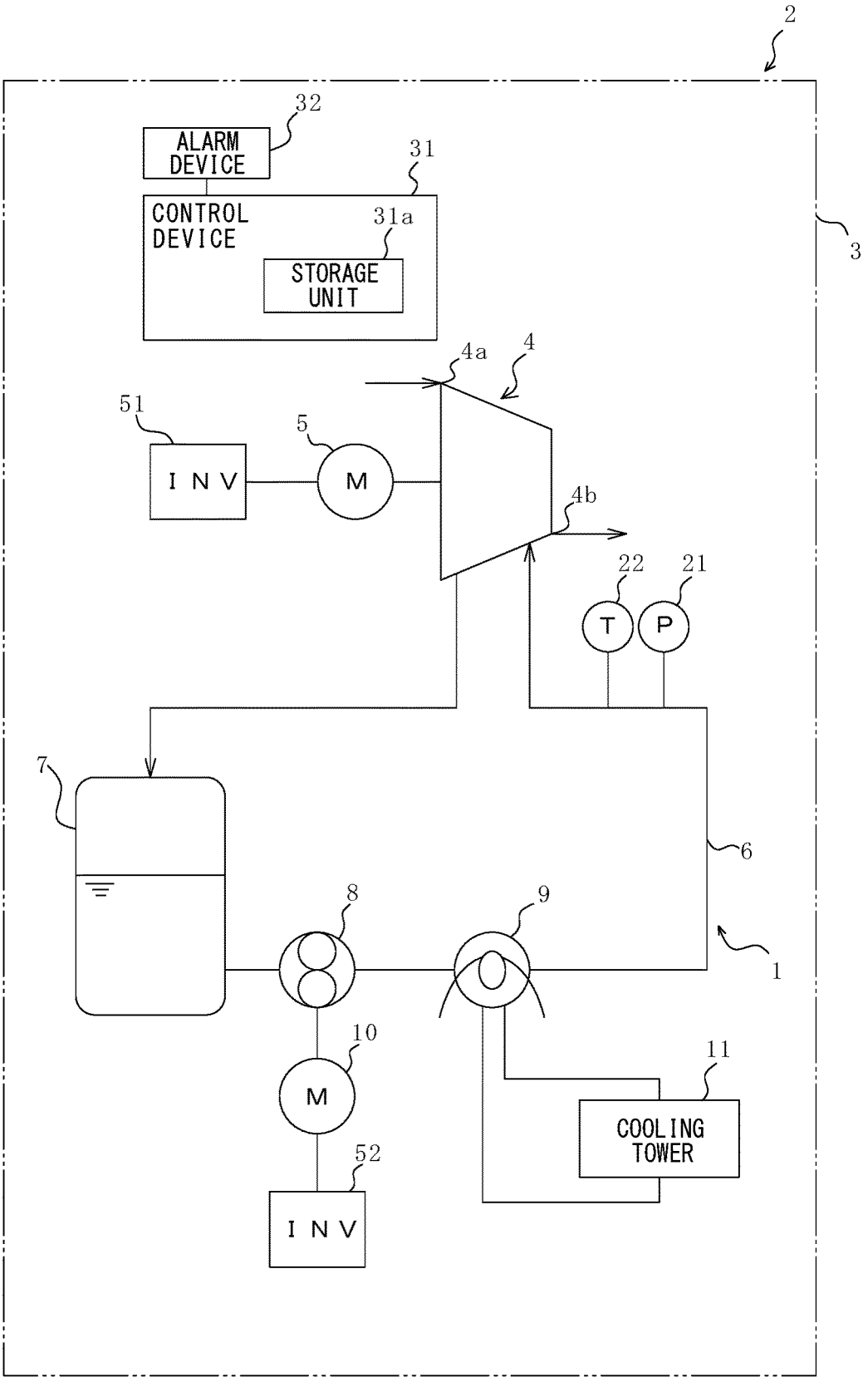
FIG. 14 is a schematic diagram of the screw compressor including an oiling device according to a fifth embodiment of the present invention.

In the fifth embodiment of the present invention shown in FIG. 14, the compressor body 4 includes the inverter 51 for controlling the rotation of the main motor 5, and the oiling device 1 includes an inverter (second inverter) 52 for controlling the rotation of the pump motor 10 that drives the oil pump 8.

As with any of the second to fourth embodiments, the storage unit 31*a* of the control device 31 has stored therein a relationship between the rotational frequency of the main motor 5 and the abnormality detection pressure as a plurality of functions according to oiling temperatures (FIGS. 8 and 11). Furthermore, as with any of the second to fourth embodiments, the storage unit 31*a* of the control device 31 has stored therein a relationship between the rotational frequency of the main motor 5 and the abnormal stop pressure as a plurality of functions according to oiling temperatures (FIGS. 8, 12, and 13).

The control unit 31 controls the rotational frequency of the pump motor 10 so that the oiling pressure does not become an abnormality detection pressure corresponding to an oiling temperature that has been detected by the oil temperature sensor 22 (so that the oiling pressure exceeds the abnormality detection pressure). Furthermore, after the oiling pressure has become equal to or lower than the abnormality detection pressure corresponding to the oiling temperature detected by the oil temperature sensor 22, the control unit 31 controls the rotational frequency of the pump motor 10 so that the oiling pressure exceeds an abnormal stop pressure corresponding to the oiling temperature detected by the oil temperature sensor 22.

As with the second to fourth embodiments, in addition to the reduction of the power required of the oiling device 1 (the power required to drive the pump motor 10) because of the fact that there is no need to wastefully increase the oiling pressure of the oiling device 1 (the discharge pressure of the oil pump 8) to avoid an abnormal stop at the time of high oiling temperature, the amount of oiling can be kept to a minimum by allowing the discharge pressure of the oil pump 8 to conform with the abnormality detection pressure or the abnormal stop pressure. The reduction of the amount of oiling makes it possible to operate the oil pump 8 at low speed, and therefore it is possible to reduce the power required of the pump motor 10 that drives the oil pump 8 and further contribute to energy saving.

Sixth Embodiment

Figure 15:
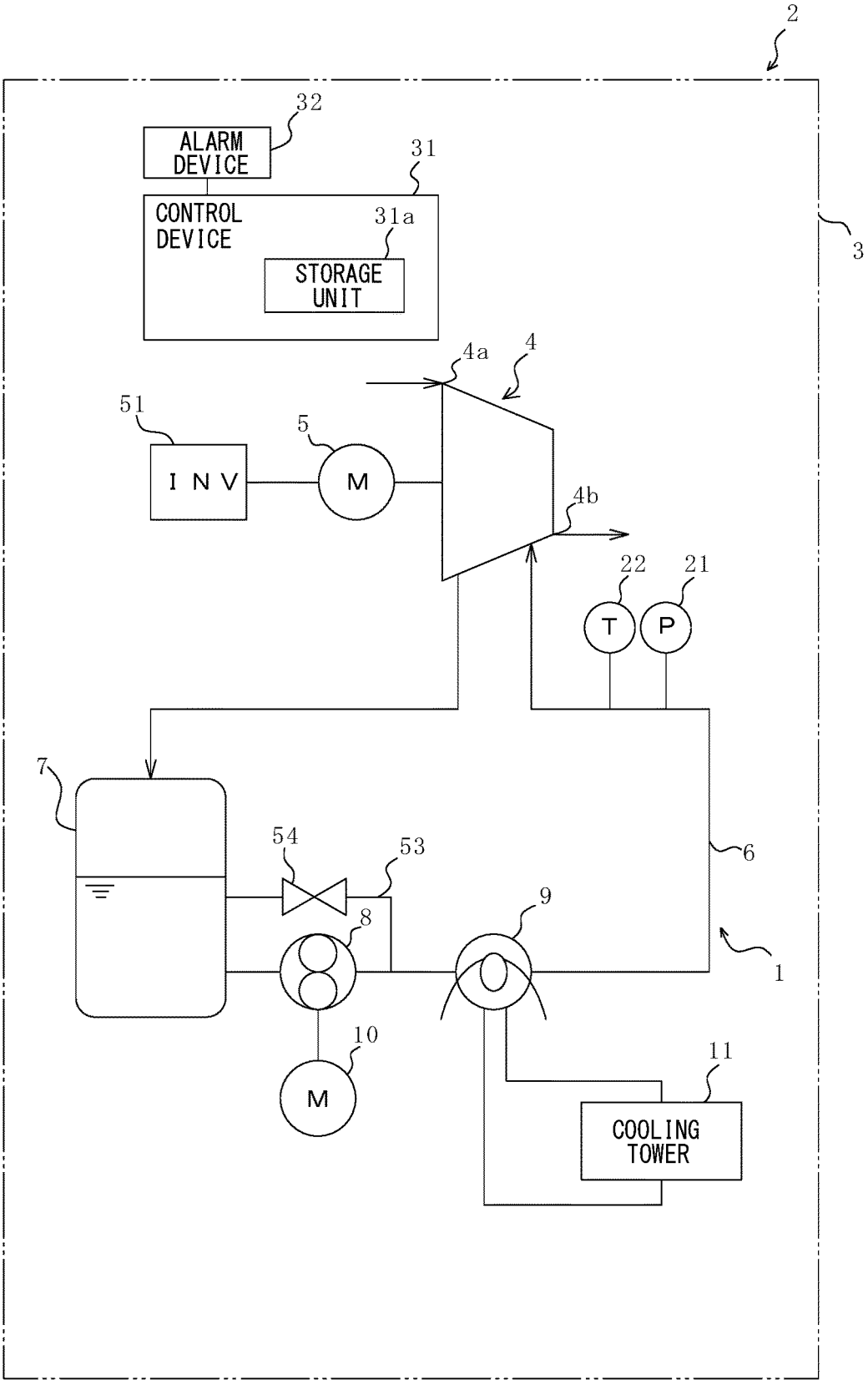
FIG. 15 is a schematic diagram of the screw compressor including an oiling device according to a sixth embodiment of the present invention.

In the sixth embodiment of the present invention shown in FIG. 15, the passage system 6 includes a return passage 53 that diverges from the discharge side of the oil pump 8 and returns to the oil tank 7. A solenoid valve 54 controlled to be open or closed by the control device 31 is provided in the return passage 53. When the solenoid valve 54 is closed, the whole amount of oil discharged by the oil pump 8 is fed into the compressor body 4; when the solenoid valve 54 is open, a large portion of oil discharged by the oil pump 8 returns to the oil tank 7 through the return passage 53. Although the pump motor 10 that drives the oil pump 8 rotates at constant speed, the amount of oiling to the compressor body 4 is adjusted by the control device 31 adjusting the open-closed ratio of the solenoid valve 54.

As with any of the second to fourth embodiments, the storage unit 31*a* of the control device 31 has stored therein a relationship between the rotational frequency of the main motor 5 and the abnormality detection pressure as a plurality of functions according to oiling temperatures (FIGS. 8 and 11). Furthermore, as with any of the second to fourth embodiments, the storage unit 31*a* of the control device 31 has stored therein a relationship between the rotational frequency of the main motor 5 and the abnormal stop pressure as a plurality of functions according to oiling temperatures (FIGS. 8, 12, and 13).

The control unit 31 controls the open-closed ratio of the solenoid valve 54 so that the oiling pressure exceeds an abnormality detection pressure corresponding to an oiling temperature detected by the oil temperature sensor 22. Furthermore, after the oiling pressure has become equal to or lower than the abnormality detection pressure corresponding to the oiling temperature detected by the oil temperature sensor 22, the control unit 31 controls the open-closed ratio of the solenoid valve 54 so that the oiling pressure exceeds an abnormal stop pressure corresponding to the oiling temperature detected by the oil temperature sensor 22.

As with the second to fourth embodiments, in addition to the reduction of the power required of the oiling device 1 (the power required to drive the pump motor 10) because of the fact that there is no need to wastefully increase the oiling pressure of the oiling device 1 (the discharge pressure of the oil pump 8) to avoid an abnormal stop at the time of high oiling temperature, the amount of oiling can be kept to a minimum by allowing the discharge pressure of the oil pump 8 to conform with the abnormality detection pressure or the abnormal stop pressure. The reduction of the amount of oiling makes it possible to reduce agitation loss of oil caused by components such as a bearing and a gear wheel included in an oiling object, and therefore it is possible to further contribute to energy saving.

Seventh Embodiment

Figure 16:
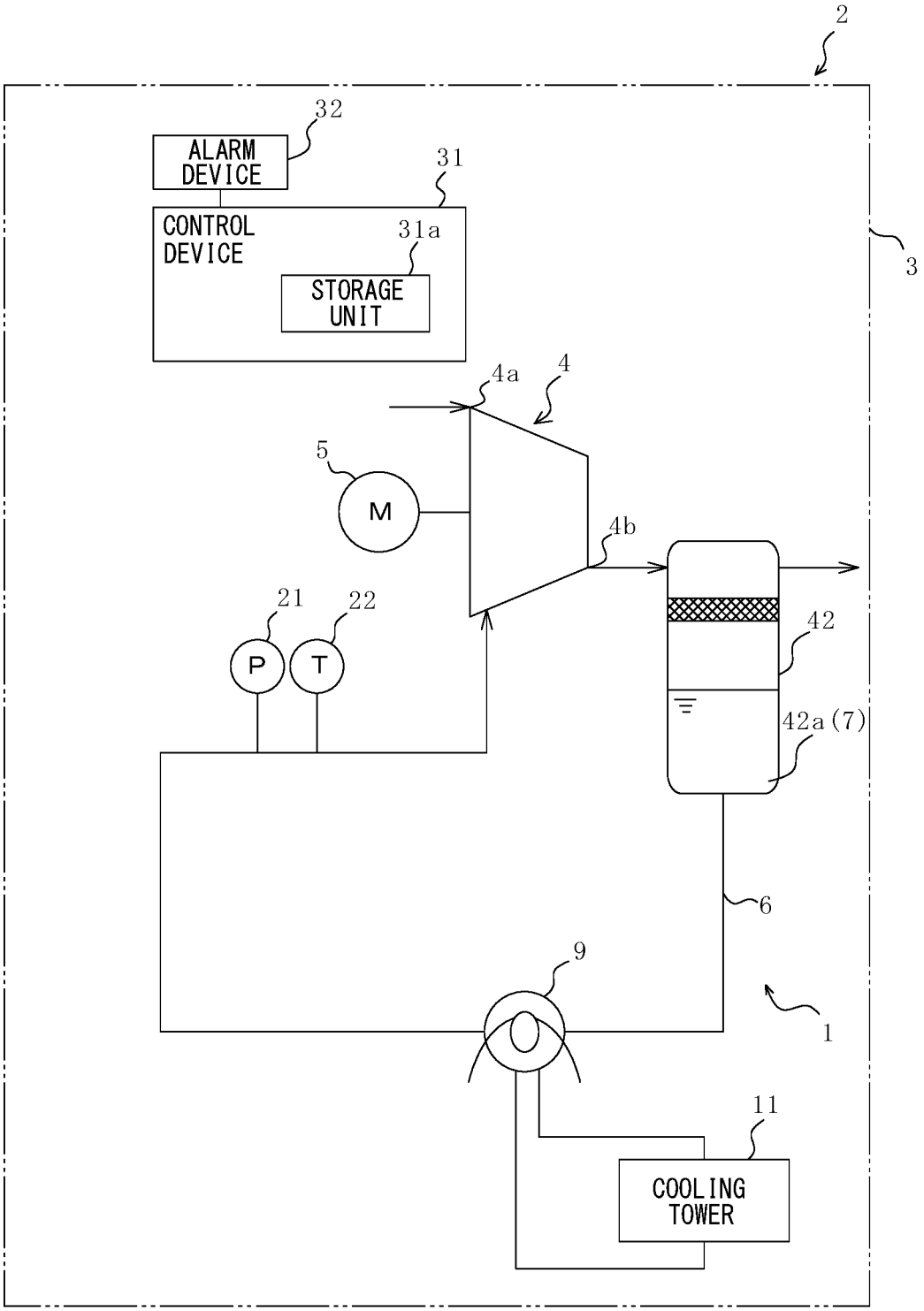
FIG. 16 is a schematic diagram of the screw compressor including an oiling device according to a seventh embodiment of the present invention.

As shown in FIG. 16, the present invention can also be applied to the oiling device 1 that the compressor body 4 thereof is an oil-injected screw compressor, and does not include the oil pump 8 and uses the discharge pressure of the compressor body 4 to pump oil from the oil reservoir 42*a* of the oil separator/collector 42 into the compressor body 4.

In the first to seventh embodiments, the compressor body 4 that is a screw compressor is described as an example of an oiling object; however, an oiling object of the present invention is not limited to it, and may be other industrial machinery having an interlock function with respect to oiling abnormality.

The invention claimed is:

1. An oiling device comprising:

a passage system that circulates and feeds oil to an oiling object;

an oiling pressure detecting unit that detects an oiling pressure that is a pressure of the oil fed to the oiling object through the passage system;

an oiling temperature detecting unit that detects an oiling temperature that is a temperature of the oil fed to the oiling object through the passage system; and a control unit that executes an abnormal stop of the oiling object, wherein the control unit includes a storage unit that has stored therein a first abnormality pressure set value that is predetermined and varies according to the oiling temperature such that the first abnormality pressure set value decreases as the oiling temperature increases, and the control unit executes the abnormal stop of the oiling object when the oiling pressure detected by the oiling pressure detecting unit is equal to or lower than the first abnormality pressure set value corresponding to the oiling temperature detected by the oiling temperature detecting unit.

2. The oiling device according to claim 1, further comprising an alarm unit that sends out an abnormality alarm, wherein the storage unit has further stored therein a second abnormality pressure set value that is predetermined and varies according to the oiling temperature such that the second abnormality pressure set value decreases as the oiling temperature increases, and being set to a higher pressure than the first abnormality pressure set value in a case of the same oiling temperature, and the control unit causes the alarm unit to send out the abnormality alarm when the oiling pressure detected by the oiling pressure detecting unit is equal to or lower than the second abnormality pressure set value corresponding to the oiling temperature detected by the oiling temperature detecting unit.

3. The oiling device according to claim 1, comprising a first motor that drives the oiling object, wherein the oiling object is a screw compressor including male and female rotors driven by the first motor.

4. The oiling device according to claim 3, comprising an oil pump that is driven by the first motor thereby generating the oiling pressure.

5. The oiling device according to claim 2, comprising a first motor that drives the oiling object, and a first inverter for controlling a rotational frequency of the first motor, wherein the storage unit has stored therein a relationship between the rotational frequency of the first motor and the first abnormality pressure set value as a plurality of functions defined according to the oiling temperature, the plurality of functions being set such that the first abnormality pressure set value with respect to the same rotational frequency of the first motor to becomes lower as the oiling temperature being higher.

6. The oiling device according to claim 5, comprising:

an oil pump that generates the oiling pressure;

a second motor that drives the oil pump; and a second inverter that controls rotational frequency of the second motor, wherein the control unit controls the rotational frequency of the second motor such that the oiling pressure exceeds the second abnormality pressure set value corresponding to the oiling temperature detected by the oiling temperature detecting unit.

7. The oiling device according to claim 4, comprising a valve that is provided in the passage system and adjusts an amount of oiling that is an amount of the oil fed from the oil pump to the screw compressor.

8. The oiling device according to claim 1, comprising a heat exchanger that is provided in the passage system and causes the oil to fall in temperature by heat exchange with a cooling medium, wherein the oiling temperature detecting unit includes a cooling medium temperature detecting unit that detects a cooling medium temperature that is a temperature of the cooling medium, and the control unit estimates the oiling temperature based on the cooling medium temperature detected by the cooling medium temperature detecting unit.

9. An oiling device comprising:

a passage system that circulates and feeds oil to an oiling object driven;

an oiling pressure detecting unit that detects an oiling pressure that is a pressure of the oil fed to the oiling object through the passage system;

an oiling temperature detecting unit that detects an oiling temperature that is a temperature of the oil fed to the oiling object through the passage system; and a control unit, wherein the control unit includes a storage unit that has stored therein a first abnormality pressure set value that is predetermined and varies according to the oiling temperature such that the first abnormality pressure set value decreases as the oiling temperature increases, and when the oiling pressure detected by the oiling pressure detecting unit is equal to or lower than the first abnormality pressure set value corresponding to the oiling temperature detected by the oiling temperature detecting unit, the control unit considers that there is an abnormality in an oiling state and outputs a signal.

10. The oiling device according to claim 9, wherein the control unit further executes an abnormal stop of the oiling object, and the signal output is an abnormal stop signal to stop driving of the oiling object.

11. An abnormality detection method of an oiling device, comprising:

detecting an oiling pressure that is a pressure of oil fed from the oiling device to an oiling object driven;

detecting an oiling temperature that is a temperature of the oil fed to the oiling object; and determining that there is occurrence of an abnormality in an oiling state when the oiling pressure falls below an abnormality pressure set value that varies according to the oiling temperature such that the abnormality pressure set value decreases as the oiling temperature increases.

12. The abnormality detection method of the oiling device according to claim 11, further comprising stopping driving of the oiling object when it has been determined that there is the occurrence of an abnormality in an oiling state.

13. The abnormality detection method of the oiling device according to claim 11, further comprising issuing an alarm of an abnormality of the oiling object when it has been determined that there is the occurrence of an abnormality in an oiling state.

* * * * *